United States Patent [19]

Bai

[11] Patent Number: 4,686,885

[45] Date of Patent: Aug. 18, 1987

[54] APPARATUS AND METHOD OF SAFE AND ARMING MUNITIONS

[75] Inventor: Monty W. Bai, Scottsdale, Ariz.

[73] Assignee: Motorola, Inc., Schaumburg, Ill.

[21] Appl. No.: 853,247

[22] Filed: Apr. 17, 1986

[51] Int. Cl.[4] ..... F42C 17/00

[52] U.S. Cl. ..... 89/6.5; 102/206; 102/221

[58] Field of Search ..... 89/6, 6.5; 102/206, 102/221, 270

[56] References Cited

U.S. PATENT DOCUMENTS

| | | | |
|---|---|---|---|
| 4,142,442 | 3/1979 | Tuten | 102/215 |
| 4,204,475 | 5/1980 | Fowler | 102/221 |
| 4,300,452 | 11/1981 | Beuchot et al. | 89/6 |
| 4,454,815 | 6/1984 | Beck | 89/6.5 |
| 4,470,351 | 9/1984 | Farace | 102/215 |
| 4,495,851 | 1/1985 | Koerner et al. | 89/6.5 |
| 4,543,457 | 9/1985 | Petersen et al. | 200/61.45 |

*Primary Examiner*—Charles T. Jordan

*Attorney, Agent, or Firm*—Raymond J. Warren; Eugene A. Parsons

[57] ABSTRACT

The present invention consists of a safe and arming apparatus and method that generates a magnetic field across a portion of the munition. The magnetic field provides a signal of arming data which is read by the safe and arming device in the munition. This signal is used with the velocity of the munition, after firing, to set the arming delay or the munition.

5 Claims, 5 Drawing Figures

APPARATUS AND METHOD OF SAFE AND ARMING MUNITIONS

BACKGROUND OF THE INVENTION

The present invention relates, in general, to safe and arming devices and, more particularly, to smart safe and arming devices Many safe and arming devices are known in the art. One such S&A device can be seen in U.S. Pat. No. 4,470,351 which was developed by Louis P. Farace and assigned to Motorola Inc.

Generally electromechanical safe and arming devices operate on fixed time delays which provide long arming distances for high speed projectiles and short delays for slow speed projectiles.

While counting the turns of a weapon can provide constant calibers arming for a given weapon, regardless of launch velocity, a different caliber delay results when fired from a weapon having a different bore diameter or different twist.

There is also a problem when one type of munition is used for more than one purpose. An example of this can be seen in the different military specifications for the same object. The Navy may require that a projectile be armed at a further distance from the gun than the Army since the Army may be shooting at closer targets.

SUMMARY OF THE INVENTION

Accordingly, it is an object of the present invention to provide an apparatus and method of safe and arming a munition that overcomes the above deficiencies.

A further object of the present invention is to provide an apparatus and method of safe and arming a munition that is programmable.

Another object of the present invention is to provide an apparatus and method of safe and arming a munition that will arm at the optimum distance regardless of the gun type or shot zone.

Still another object of the present invention is to provide an apparatus and method of safe and arming a munition that does not require physical contact with the munition.

Yet another object of the present invention is to provide a method and apparatus of safe and arming a munition that will provide a verification signal to verify the setting.

The above and other objects and advantages of the present invention are provided by the apparatus and method of safe and arming a munition described herein.

A particular embodiment of the present invention consists of a safe and arming device that can be set externally using a magnetic field. The desired data is fed into a setting unit which causes a magnetic field generated through a safe and arming device to transmit the data to a munition. The magnetic field may set the safe and arming device in any one of several ways which will be discussed in detail below. This data may then be verified and used to calculate the time delay before arming the munition once the munition is fired.

DETAILED DESCRIPTION OF THE DRAWINGS

Figure 1:
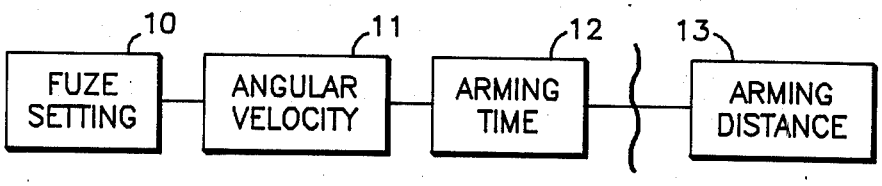
FIG. 1 is a flow chart of a method, embodying the present invention, used in safe and arming a munition.

Referring now to the flow chart of FIG. 1, a method of setting a safe and arming device will be described. Initially, the fuze is set, block 10, using a device described below in FIG. 2. This setting can provide various information to the fuze such as the fuze mode, timing, rifling and/or arming turns. This information is then stored in the fuze and may be checked by various methods, such as a transmitted microwave signal or the like.

Upon firing the munition, the angular velocity can be determined, block 11, by one of various methods known in the art. The angular velocity, when used with the information set prior to firing, block 10, is used in block 12 to determine the time delay for arming the device. This allows the munition to arm at an optimum distance from the gun.

A block 13 is also shown for determining the arming distance of the munition. While this is not required for the accurate operation of the fuze, it has been included to show the distance traveled before arming occurs.

At least one of the data items is required for setting the fuze. The arming turns, $T_{arm}$, is the number of rotational turns required to be completed prior to arming the munition. The following example is the method used if the arming turns is the data provided.

Upon firing the munition, the angular velocity, $V_a$, may be determined by the equation;

$$V_a=(F/mR)^{\frac{1}{2}} \quad (1)$$

where:

F is the centrifugal force generated by the rotation of the munition;

m is the mass of the munition; and

R is the radius of the munition.

The rotations per second, RPS, can then be determined by;

$$RPS=(V_a/2\pi). \quad (2)$$

The rotations per second can then be used to determine the arming time, $t_{arm}$, by the equation;

$$t_{arm}=(T_{arm}/RPS). \quad (3)$$

Substituting equations (1) and (2) into equation (3) reduces to:

$$t_{arm}=[2\pi T_{arm}/(F/mR)^{\frac{1}{2}}] \quad (4)$$

Arming time is the delay time from firing to arming of the munition.

If desired, the distance can also be determined from the arming time, equation (3), if the rifling, tan (E), has also been provided in the fuze setting stage, block 10. The rifling represents the twisting of the interior of the gun barrel which places a rotation on the munition when fired. The angle E is the angle of rotation at the time the munition leaves the gun barrel. For example, if a munition having a 6 inch circumference was fired from a gun having a rifling of 1/20 or 0.05, then for each rotation the munition makes it will have traveled, linearly, 120 inches. This relation is regardless of the linear velocity of the munition.

The linear distance to arming, $X_{arm}$, can then be determined by;

$$X_{arm}=[2\pi R/tan\ (E)]T_{arm}. \quad (5)$$

By way of a second example, the distance to arm, $X_{arm}$ may be the data provided in the setting stage. With this information, the linear velocity, $V_1$ would be determined at firing. With the distance and velocity the arming time can be determined from the equation:

$$t_{arm}=(X_{arm}/V_1) \quad (6)$$

Figure 2:
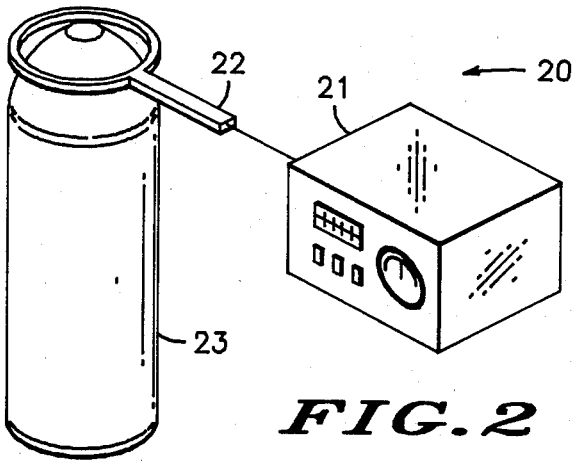
FIG. 2 is a block diagram of a device, embodying the present invention, used for setting a munition.

Referring now to the block diagram of FIG. 2, a setting device, generally designated 20, is illustrated. Device 20 consists of a control unit 21, a setting magnetic field generator 22, and a munition 23. The number of arming turns is set in control unit 21, along with any other information desired. This is then transmitted to magnetic field generator 22 which is placed about munition 23 in an area that contains a sensor capable of reacting to the magnetic fields generated. This sensor will be described in more detail below with respect to FIGS. 4 and 5. FIG. 2 is illustrative of the fact that physical contact is not required in order to set the munition.

Figure 3:
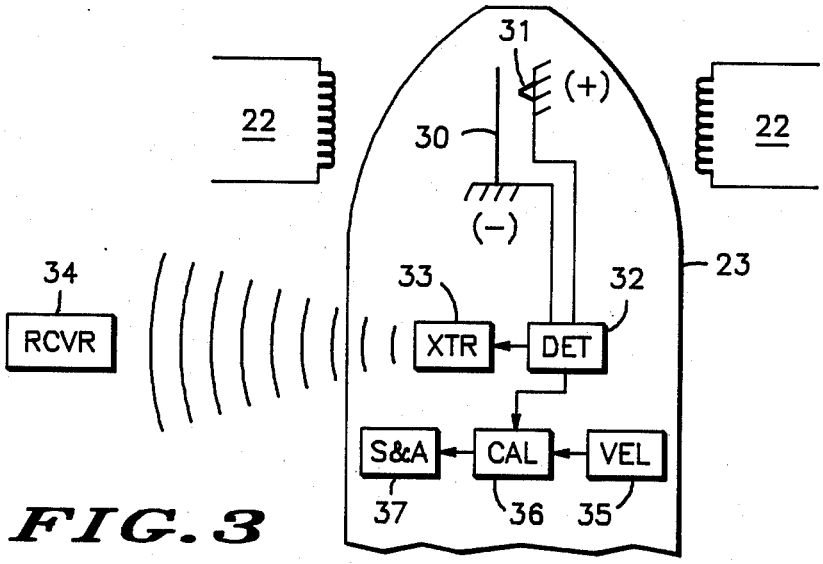
FIG. 3 is a sectional view, with portions broken away, of a device, embodying the present invention, for setting a munition.

Referring now to the block diagram of FIG. 3, a sectional view of munition 23 is illustrated. As shown munition 23 is surrounded with magnetic field generator 22. The magnetic field generated will cause a beam 30 to be drawn to a contact point 31. When beam 30 and point 31 are in contact detector 32 is activated to read and store the information being transmitted to munition 23 by generator 22.

There are several ways in which the data can be transmitted to detector 32 through beam 30 and point 31. The magnetic field could be turned on and off causing beam 30 and point 31 to make and break contact thereby generating a type of square wave signal indicative of the information being transmitted. In another embodiment the magnetic field could be turned on leaving beam 30 and point 31 in contact for an amount of time indicative of the desired setting. In yet another embodiment, the intensity of the magnetic field could be measured and used to indicate the desired setting.

Once the setting information is received by detector 32 the information is transmitted out of the munition by a transmitter 33. This is received by a receiver 34 which verifies that the correct information has been stored. This technique is not used for setting the device to prohibit unauthorized or accidental setting of the fuze.

Upon firing of the munition the angular velocity of the munition is determined by a velocity detector 35. The rotations per second from velocity detector 35 and the arming turns from detector 32 are then transmitted to a calculator 36. Calculator 36 determines the arming time delay, $t_{arm}$. After the calculated amount of time has elapsed, the calculator sends an arming signal to safe and arming circuit 37.

Figure 4:
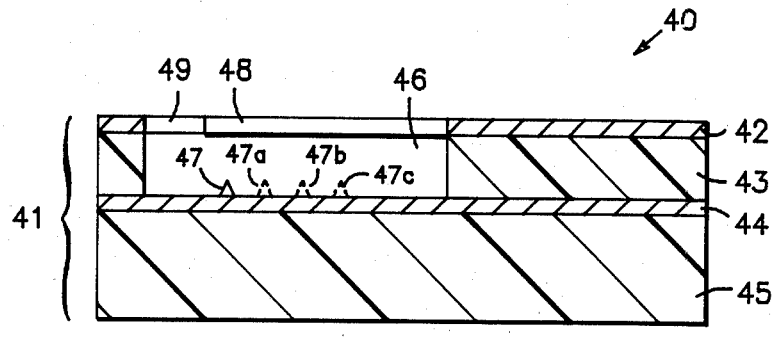
FIG. 4 is a cross-sectional side view of a microbeam used in setting the safe and arming device.
Figure 5:
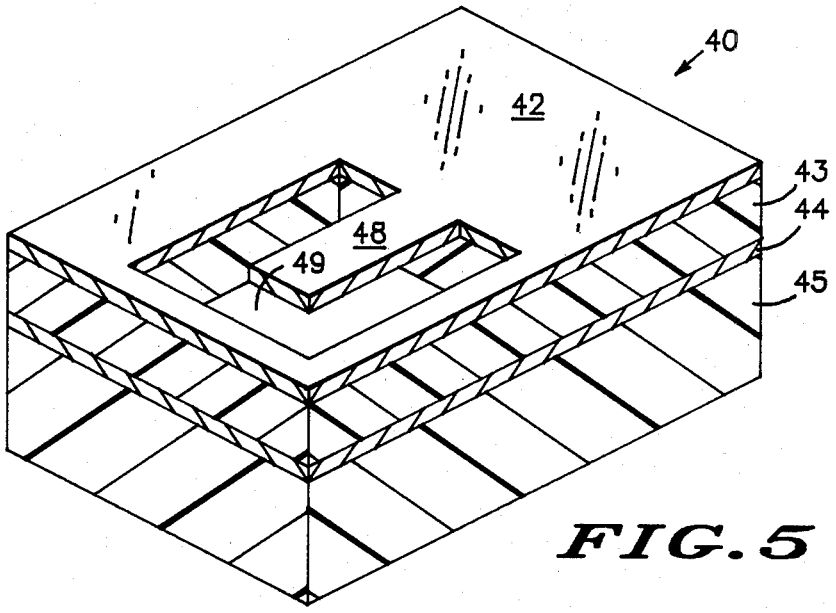
FIG. 5 is a view in perspective of the microbeam device described in FIG. 4.

Referring now to FIGS. 4 and 5, a partial cross-sectional side view, FIG. 4, and a view in perspective, FIG. 5, of a magnetic detector 40 is illustrated. Magnetic detector 40 is a magnetically responsive, microminiature beam switch being defined by a reduced thickness silicon wafer. A stationary contact member is disposed adjacent to and spaced from the beam such that when the beam is bent an electrical contact means associated with confronting surfaces of the beam and contact member will connect.

A specific embodiment of magnetic detector 40 consists of a wafer 41 having four layers: a first conductive layer 42; a first insulative layer 43; a second conductive layer 44 and a second insulative layer 45. As shown, a portion of layer 43 has been removed leaving an opening 46 and a conductive contact point 47. An opening 49 has also been etched out about a portion of layer 42 leaving a beam 48, see FIG. 5.

When a magnetic field is generated across detector 40, conductive beam 48 is deflected toward conductive contact point 47. If the data is to be transmitted by pulses, beam 48 is bent and released the desired number of times. If the data is determined by the duration of the contact, then beam 48 is made to contact point 47 and left for the appropriate amount of time. If the data is to be determined from the intensity of the magnetic field then the number of contact points 47, 47*a*, etc. touching beam 48 will indicate the desired setting. As the intensity of the magnetic field increases, beam 48 will come into contact with more of the contact points.

One example of the microbeam and a more detailed description of its operation can be found in U.S. Pat. No. 4,543,457.

Thus, it is apparent to one skilled in the art that there has been provided in accordance with the invention, an apparatus and method that fully satisfies the objects, aims and advantages set forth above.

It has been shown that the present invention provides an apparatus and method of safe and arming a munition that is programmable; will arm at an optimum distance; does not require physical contact; and will verify the input data.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

I claim:

1. A method of safe and arming a munition comprising the steps of:

transmitting arming data to said munition using a magnetic field by setting a control unit to provide said arming data and generating a magnetic field about a portion of said munition containing a setting receiver, said setting receiver being a magnetically responsive, microminiature switch comprising a silicon wafer having a reduced thickness, deflectable beam adapted to move from a relaxed condition toward increasing bending conditions upon the application of an increasingly greater magnetic field, a stationary contact member disposed adjacent and spaced from said beam, with the latter in its relaxed condition, the beam and contact member defining a pair of confronting surfaces, a pair of switch terminals and electrical contact means associated with said confronting surfaces for connecting said pair of switch terminals conductive when the beam is moved from its relaxed condition to a preselected bending position;

firing said munition;

calcualting an arming time of said munition; and arming said munition after the expiration of said arming time.

2. The method of claim 1 wherein said arming time is calculated using the following algorithm, $$t_{arm}=(X_{arm}/V_1)$$

where:

$t_{arm}$ is said arming time;

$V_1$ is said velocity and is a linear velocity; and $X_{arm}$ is said arming data and represents an arming distance.

3. A method of safe and arming a munition comprising the steps of:

transmitting arming data to said munition using a magnetic field;

firing said munition;

calculating an arming time of said munition by measuring a velocity of said munition and calculating said arming time using the following algorithm, $$t_{arm}=[2\pi T_{arm}/(F/mR)^{\frac{1}{2}}]$$

where:

$t_{arm}$ is said arming time, $T_{arm}$ is said arming data and represents arming turns and F/mR is said velocity and is an angular velocity where F is a centrifugal force generated by a spin of said munition, m is the mass of said munition and R is the radius of said munition; and arming said munition after the expiration of said arming time.

4. A method of safe and arming a munition comprising the steps of:

setting a control unit to provide arming turns;

generating a magnetic field about a portion of said munition containing a setting receiver, said setting receiver being a magnetically responsive, microminature swithh comprising a silicon wafer having a reduced thickness, deflectable beam adapted to move from a relaxed condition toward increasing bending conditions upon the application of an increasingly greater magnetic field, a stationary contact member disposed adjacent and spaced from said beam, with the latter in its relaxed condition, the beam and contact member defining a pair of confronting surfaces, a pair of switch terminals and electrical contact means associated with said confronting surfaces for connecting said pair of switch terminals conductive when the beam is moved from its relaxed condition to a preselected bending position;

firing said munition;

measuring an angular velocity of said munition;

calculating an arming time using said arming turns and said angular velocity; and arming said munition after the expiration of said arming time.

5. The method of claim 4 wherein said arming time is calculated using the following algorithm, $$t_{arm}=[2\pi T_{arm}/(F/mR)^{\frac{1}{2}}]$$

where $t_{arm}$ is said arming time;

$T_{arm}$ is said arming data and represents an arming turns; and

F/mR is said velocity and is an angular velocity where F is a centrifugal force generated by a spin of said munition, m is a mass of said munition, and R is a radius of said munition.

* * * * *